US011244618B2

(12) United States Patent
Wen et al.

(10) Patent No.: US 11,244,618 B2
(45) Date of Patent: Feb. 8, 2022

(54) AMOLED PIXEL DRIVING CIRCUIT AND DRIVING METHOD

(71) Applicant: Shenzhen China Star Optoelectronics Semiconductor Display Technology Co., Ltd., Shenzhen (CN)

(72) Inventors: Shu Wen, Shenzhen (CN); Yichien Wen, Shenzhen (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 604 days.

(21) Appl. No.: 16/320,464

(22) PCT Filed: Oct. 16, 2018

(86) PCT No.: PCT/CN2018/110537

§ 371 (c)(1),
(2) Date: Jan. 24, 2019

(87) PCT Pub. No.: WO2020/062352

PCT Pub. Date: Apr. 2, 2020

(65) Prior Publication Data

US 2021/0358411 A1 Nov. 18, 2021

(30) Foreign Application Priority Data

Sep. 27, 2018 (CN) ..... 201811133800.5

(51) Int. Cl.

| | |
|---|---|
| ***G09G 3/3233*** | (2016.01) |
| ***G09G 3/3258*** | (2016.01) |
| ***G09G 3/3266*** | (2016.01) |

(52) U.S. Cl.
CPC ..... *G09G 3/3258* (2013.01); *G09G 3/3266* (2013.01); *G09G 3/3233* (2013.01);
(Continued)

(58) Field of Classification Search
CPC .. G09G 3/3208; G09G 3/3225; G09G 3/3233; G09G 3/3258; G09G 3/3266;
(Continued)

(56) References Cited

U.S. PATENT DOCUMENTS

2008/0111812 A1* 5/2008 Shirasaki ..... G09G 3/3233 345/212
2009/0002282 A1* 1/2009 Tomida ..... G09G 3/3275 345/76

(Continued)

FOREIGN PATENT DOCUMENTS

CN 104680982 A 6/2015
CN 105185300 A 12/2015
CN 106205495 A 12/2016

*Primary Examiner* — Michael J Eurice
(74) *Attorney, Agent, or Firm* — Leong C. Lei

(57) ABSTRACT

The invention provides an AMOLED pixel driving circuit and method. The AMOLED pixel driving circuit is disposed with a voltage switching module corresponding to each row of sub-pixels, and the voltage switching module is connected to a corresponding row of sub-pixels and scan line corresponding to the row of sub-pixels. The scan signal on the scan line controls the corresponding voltage switching module to provide different power supply voltages to the row of sub-pixels when the switching TFTs in the corresponding row of sub-pixels are turned on and off, thereby compensating for the voltage difference change caused by the parasitic capacitance between the drain and the gate of the switching TFT when the switching TFT changes from on to off, ensuring a stable current flowing through the OLED, and improving the display consistency of the sub-pixels to ensure display quality.

7 Claims, 8 Drawing Sheets

(52) U.S. Cl.
CPC ..... *G09G 2300/0842* (2013.01); *G09G 2310/0278* (2013.01); *G09G 2320/0223* (2013.01); *G09G 2320/0233* (2013.01); *G09G 2320/0626* (2013.01)

(58) Field of Classification Search
CPC ... G09G 2300/0842; G09G 2310/0278; G09G 2320/0223; G09G 2320/0233; G09G 2320/045; G09G 2320/0626
See application file for complete search history.

(56) References Cited

U.S. PATENT DOCUMENTS

2009/0295423 A1* 12/2009 Levey ..... G09G 3/006 324/760.01
2010/0091006 A1* 4/2010 Yoo ..... G09G 3/3233 345/213
2012/0313923 A1* 12/2012 Minami ..... G09G 3/3233 345/212
2015/0129903 A1* 5/2015 Yamamoto ..... G09G 3/3233 257/88
2016/0063922 A1* 3/2016 Tsai ..... G09G 3/3291 345/76
2017/0039941 A1* 2/2017 Wu ..... G09G 3/32
2017/0140704 A1* 5/2017 Cai ..... H01L 27/3262

* cited by examiner

AMOLED PIXEL DRIVING CIRCUIT AND DRIVING METHOD

BACKGROUND OF THE INVENTION

1. Field of the Invention

The present invention relates to the field of display, and in particular to an organic light-emitting diode (OLED) driving circuit and driving method.

2. The Related Arts

The organic light-emitting diode (OLED) display provides many advantages, such as, active illumination, low driving voltage, high luminance efficiency, fast response speed, high clarity and contrast, near 180° viewing angle, wide operation temperature range, ability to realize full-color display, and so on, and has become the most promising display technology.

The OLED displays can be classified into two categories according to the driving method: passive matrix OLED (PMOLED) and active matrix OLED (AMOLED), namely, direct addressing and thin film transistor (TFT) array addressing, wherein the AMOLED has a plurality of pixels arranged in an array, belongs to an active display type, has high luminous efficiency, and is generally used as a high-definition large-sized display device.

The AMOLED is a current-driven device. When a current flows through the organic light-emitting diode, the organic light-emitting diode emits light, and the light-emitting luminance is determined by the current flowing through the organic light-emitting diode. Most known integrated circuits (ICs) only transmit voltage signals, so the pixel driving circuit of the AMOLED needs to convert the voltage signal into a current signal. The conventional AMOLED pixel driving circuit is usually 2T1C-structured, that is, comprising two TFTs plus a capacitor, which converts the voltage into a current.

As shown in FIG. 1, the conventional AMOLED pixel driving circuit of the 2T1C structure using the N-type TFT comprises: a first TFT T10, a second TFT T20, a capacitor C10, and an OLED D10. The first TFT T10 has a gate connected to a scan signal Gate, a source connected to a data signal Data, and a drain electrically connected to a gate of the second TFT T20. The second TFT T20 has a drain connected to a power supply positive voltage OVDD, and a source electrically connected to an anode of the OLED D10. The OLED D10 has a cathode connected to a power supply negative voltage OVSS. Both ends of the capacitor C10 are electrically connected to the gate and the source of the second TFT T20, respectively. During display, the scan signal Gate first becomes high voltage to turn on the first TFT T10, and the data signal Data enters the gate of the second TFT T20 and the capacitor C10 through the first TFT T10, and then the scan signal Gate is low voltage to turn off the first TFT T10. As a result, due to the storage function of the capacitor C10, the gate voltage of the second TFT T20 can continue to maintain at the data signal voltage, so that the second TFT T20 is in a turned-on state, and the driving current enters the OLED D10 through the second TFT T20, and drives the OLED D10 to emit light. Actually, however, there is a parasitic capacitance between the gate and the drain of the first TFT T10, and at the instant when the scan signal Gate is changed from a high voltage to a low voltage to turn off the first TFT T10, the drain voltage of the first TFT T10, i.e., the gate voltage of the second TFT T20, will drop due to the existence of parasitic capacitance, resulting in a decrease in the gate-to-source voltage difference of the second TFT T20, which in turn lowers the luminance of the OLED D10 and affects the display quality.

As shown in FIG. 2, the conventional AMOLED pixel driving circuit of the 2T1C structure using the P-type TFT comprises: a first TFT T10', a second TFT T20', a capacitor C10', and an OLED D10'. The first TFT T10' has a gate connected to a scan signal Gate, a source connected to a data signal Data, and a drain electrically connected to a gate of the second TFT T20'. The second TFT T20' has a source connected to a power supply positive voltage OVDD', and a drain electrically connected to an anode of the OLED D10'. The OLED D10' has a cathode connected to a power supply negative voltage OVSS'. Both ends of the capacitor C10' are electrically connected to the gate and the source of the second TFT T20', respectively. During display, the scan signal Gate first becomes low voltage to turn on the first TFT T10', and the data signal Data enters the gate of the second TFT T20' and the capacitor C10' through the first TFT T10', and then the scan signal Gate is high voltage to turn off the first TFT T10'. As a result, due to the storage function of the capacitor C10', the gate voltage of the second TFT T20' can continue to maintain at the data signal voltage, so that the second TFT T20' is in a turned-on state, and the driving current enters the OLED D10' through the second TFT T20', and drives the OLED D10' to emit light. Similar to the AMOLD pixel driving circuit using N-type TFT, due to a parasitic capacitance between the gate and the drain of the first TFT T10', at the instant when the scan signal Gate is changed from a low voltage to a high voltage to turn off the first TFT T10', the drain voltage of the first TFT T10', i.e., the gate voltage of the second TFT T20', will rise, resulting in an increase in the gate-to-source voltage difference of the second TFT T20', which in turn lowers the luminance of the OLED D10' and affects the display quality.

SUMMARY OF THE INVENTION

The object of the present invention is to provide an AMOLED pixel driving circuit, able to improve the problem that the luminance of the OLED changes due to the parasitic capacitance between the gate and the drain of the switching TFT when the scan signal is turned off, and improves the display quality.

Another object of the present invention is to provide an AMOLED pixel driving method, able to improve the problem that the luminance of the OLED changes due to the parasitic capacitance between the gate and the drain of the switching TFT when the scan signal is turned off, and improves the display quality.

To achieve the above object, the present invention provides an AMOLED pixel driving circuit, comprising: a plurality of sub-pixels arranged in an array, a plurality of scan lines, a plurality of data lines, and a plurality of voltage switching modules;

each column of sub-pixels being connected to a data line; each row of sub-pixels being correspondingly connected with a scan line; each voltage switching module being correspondingly connected with a row of sub-pixels and the scan line connected by the row of sub-pixel elements, and connected to a first power source positive voltage and a second power source positive voltage;

each of the sub-pixels comprising a first P-type TFT, a second TFT, a capacitor, and an OLED; the first P-type TFT having a gate electrically connected to the corresponding scan line, a source electrically connected to the corresponding data line, and a drain electrically connected to a gate of the second TFT; the second TFT having a source electrically connected to the corresponding voltage switching module, and a drain electrically connected to an anode of the OLED; the capacitor having two ends electrically connected to the gate and the source of the second TFT respectively; the OLED having a cathode connected to a power source negative voltage;

the voltage switching module being configured to input the first power source positive voltage to the sources of the second TFTs of the corresponding row of sub-pixels when the scan signal on the scan line connected thereto turning on the first P-type TFTs in the corresponding row of sub-pixels, and to input the second power source positive voltage to the sources of the second TFTs of the corresponding row of sub-pixels when the scan signal on the scan line connected thereto turning off the first P-type TFTs in the corresponding row of sub-pixels;

the first power source positive voltage being less than the second power source positive voltage.

Wherein, each voltage switching module comprises a third N-type TFT and a fourth P-type TFT, the third N-type TFT has a gate electrically connected to the corresponding scan line, a source connected to the second power supply positive voltage and a drain electrically connected to a drain of the fourth P-type TFT and electrically connected to the source of the second TFT of the corresponding row of the sub-pixels; the fourth P-type TFT has a gate electrically connected to the corresponding scan line, and a source connected to the first power supply positive voltage.

Wherein, the second TFT is a P-type TFT.

The present invention also provides an AMOLED pixel driving method, applicable to the above AMOLED pixel driving circuit, the method comprising:

Step S1: for a positive integer n, the scan signal on the n-th scan line being a constant low voltage to control the first P-type TFT in the n-th row of sub-pixels to be turned on, and control the voltage switching module connected to the n-th row of sub-pixels to input the first power source positive voltage to the sources of the second TFTs in the n-th row of sub-pixels, and a plurality of data lines inputting the data signal to the gates of the second TFTs of the n-th row of sub-pixels;

Step S2: the scan signal on the n-th scan line being a constant high voltage to control the first P-type TFT in the n-th row of sub-pixels to be turned off, and control the voltage switching module connected to the n-th row of sub-pixels to input the second power source positive voltage to the sources of the second TFTs in the n-th row of sub-pixels, and the OLED emitting light.

The present invention also provides an AMOLED pixel driving circuit, comprising: a plurality of sub-pixels arranged in an array, a plurality of scan lines, a plurality of data lines, and a plurality of voltage switching modules;

each column of sub-pixels being connected to a data line; each row of sub-pixels being correspondingly connected with a scan line; each voltage switching module being correspondingly connected with a row of sub-pixels and the scan line connected by the row of sub-pixel elements, and connected to a first power source positive voltage and a second power source positive voltage;

each of the sub-pixels comprising a first N-type TFT, a second TFT, a capacitor, and an OLED; the first N-type TFT having a gate electrically connected to the corresponding scan line, a source electrically connected to the corresponding data line, and a drain electrically connected to a gate of the second TFT; the second TFT having a drain electrically connected to to power source positive voltage, and a source electrically connected to an anode of the OLED; the capacitor having two ends electrically connected to the gate and the source of the second TFT respectively; the OLED having a cathode connected to the corresponding voltage switching module;

the voltage switching module being configured to input the first power source negative voltage to the cathodes of the OLEDs of the corresponding row of sub-pixels when the scan signal on the scan line connected thereto turning on the first N-type TFTs in the corresponding row of sub-pixels, and to input the second power source negative voltage to the cathodes of the OLEDs of the corresponding row of sub-pixels when the scan signal on the scan line connected thereto turning off the first N-type TFTs in the corresponding row of sub-pixels;

the first power source negative voltage being larger than the second power source negative voltage.

Wherein, each voltage switching module comprises a third N-type TFT and a fourth P-type TFT, the third N-type TFT has a gate electrically connected to the corresponding scan line, a source connected to the first power supply negative voltage and a drain electrically connected to a drain of the fourth P-type TFT and electrically connected to the cathode of the OLED of the corresponding row of the sub-pixels; the fourth P-type TFT has a gate electrically connected to the corresponding scan line, and a source connected to the second power supply negative voltage.

Wherein, the second TFT is an N-type TFT.

The present invention also provides an AMOLED pixel driving method, applicable to the above AMOLED pixel driving circuit, the method comprising:

Step S1': for a positive integer n, the scan signal on the n-th scan line being a constant high voltage to control the first N-type TFT in the n-th row of sub-pixels to be turned on, and control the voltage switching module connected to the n-th row of sub-pixels to input the first power source negative voltage to the cathodes of the OLEDs in the n-th row of sub-pixels, and a plurality of data lines inputting the data signal to the gates of the second TFTs of the n-th row of sub-pixels;

Step S2': the scan signal on the n-th scan line being a constant low voltage to control the first N-type TFT in the n-th row of sub-pixels to be turned off, and control the voltage switching module connected to the n-th row of sub-pixels to input the second power source negative voltage to the cathodes of the OLEDs in the n-th row of sub-pixels, and the OLED emitting light.

The present invention provides the following advantages: the present invention provides an AMOLED pixel driving circuit, which is disposed with a voltage switching module corresponding to each row of sub-pixels, and the voltage switching module is connected to a corresponding row of sub-pixels and scan line corresponding to the row of sub-pixels. The scan signal on the scan line controls the corresponding voltage switching module to provide different power supply voltages to the row of sub-pixels when the switching TFTs in the corresponding row of sub-pixels are turned on and off, thereby compensating for the voltage difference change caused by the parasitic capacitance between the drain and the gate of the switching TFT when the switching TFT changes from on to off, ensuring a stable current flowing through the OLED, and improving the display consistency of the sub-pixels to ensure display quality. The present invention provides an AMOLED pixel driving method capable of improving the brightness change of the OLED caused by the parasitic capacitance between the gate and the drain of the switching TFT when the scan signal turns off the switching TFT to improve display quality.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
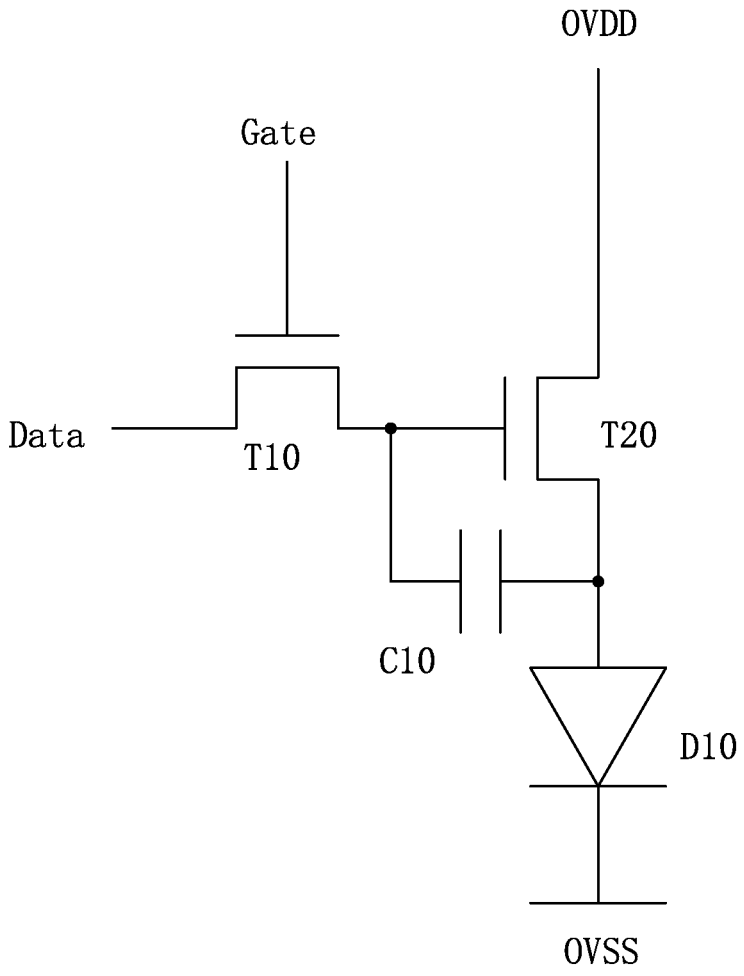
FIG. 1 is a schematic view showing a known AMOLED pixel driving circuit using a 2T1C structure of N-type TFT.
Figure 2:
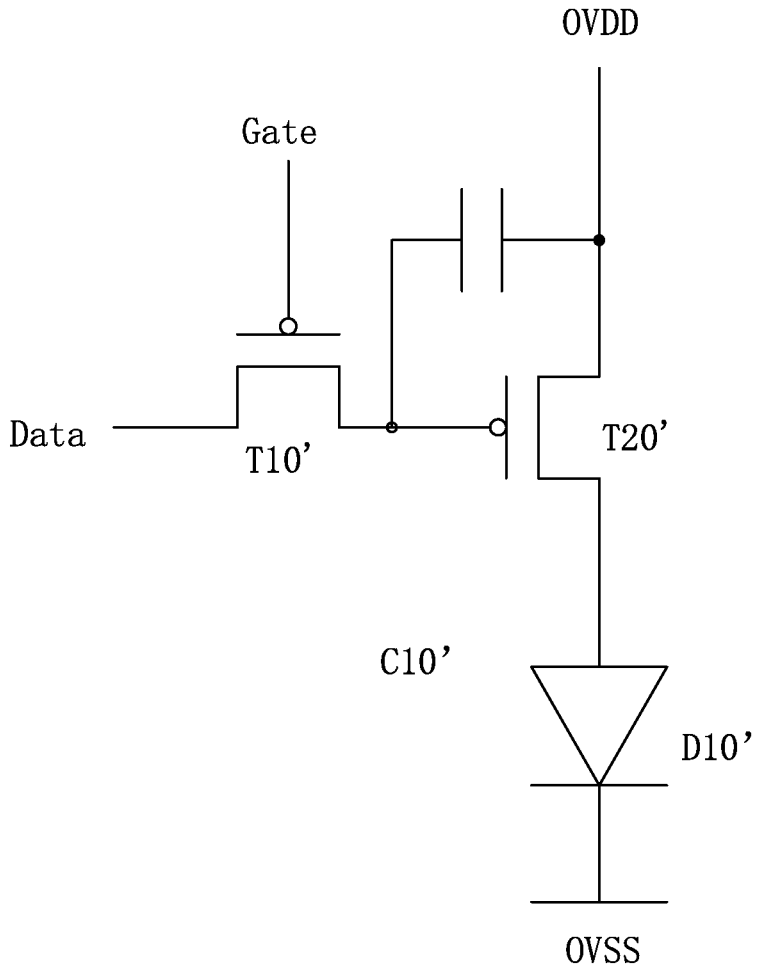
FIG. 2 is a schematic view showing a known AMOLED pixel driving circuit using a 2T1C structure of P-type TFT.
Figure 3:
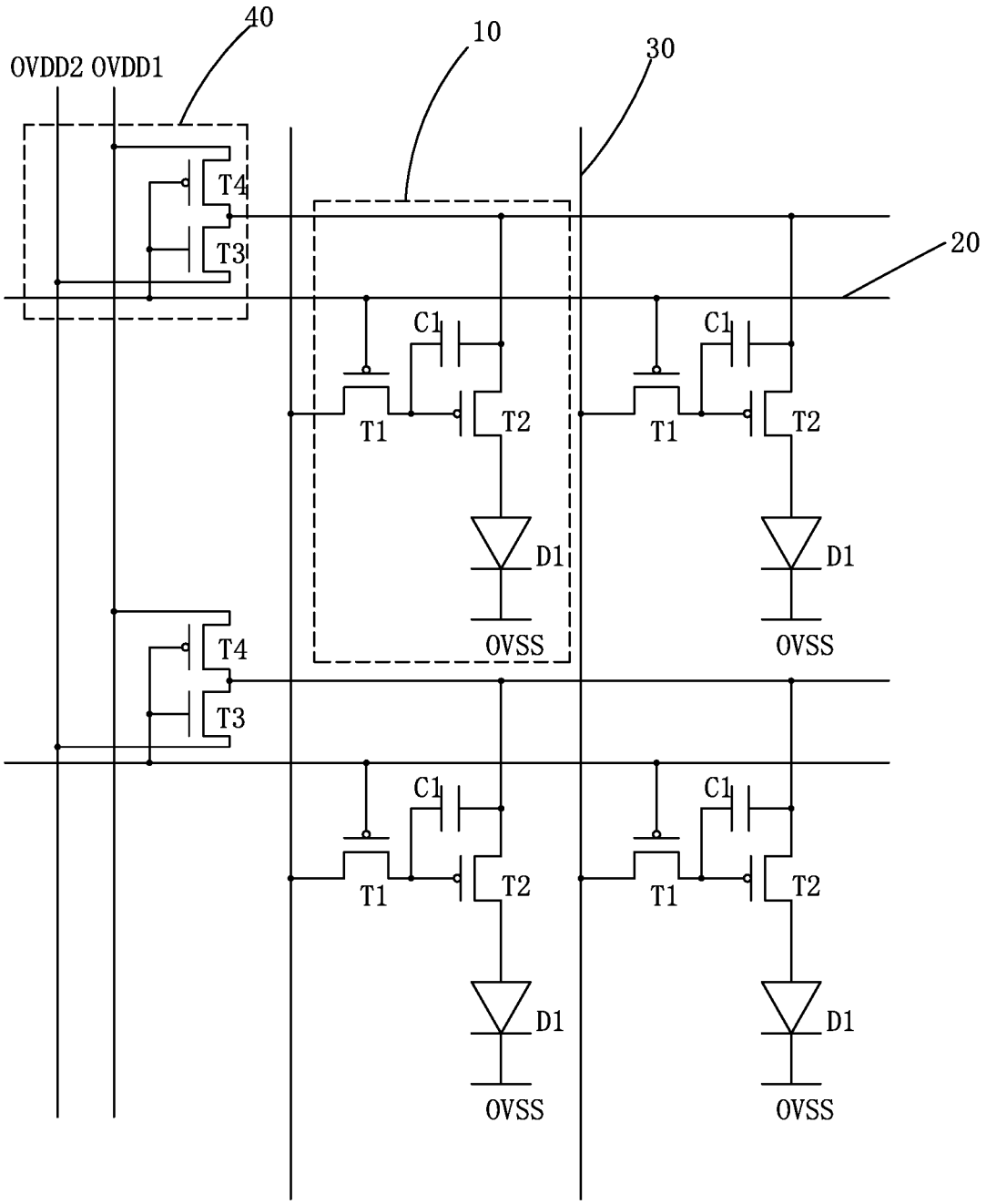
FIG. 3 is a schematic view showing the AMOLED pixel driving circuit of the first embodiment of the present invention.

Refer to FIG. 3. The AMOLED pixel driving circuit of the first embodiment of the present invention comprises: a plurality of sub-pixels 10 arranged in an array, a plurality of scan lines 20, a plurality of data lines 30, and a plurality of voltage switching modules 40.

Each column of sub-pixels 10 is connected to a data line 30; each row of sub-pixels 10 is correspondingly connected with a scan line 20; each voltage switching module 40 is correspondingly connected with a row of sub-pixels 10 and the scan line 20 connected by the row of sub-pixels 10, and connected to a first power source positive voltage OVDD1 and a second power source positive voltage OVDD2.

Each of the sub-pixels 10 comprises a first P-type TFT T1, a second TFT T2, a capacitor C1, and an OLED D1; the first P-type TFT T1 has a gate electrically connected to the corresponding scan line 20, a source electrically connected to the corresponding data line 30, and a drain electrically connected to a gate of the second TFT T2; the second TFT T2 has a source electrically connected to the corresponding voltage switching module 40, and a drain electrically connected to an anode of the OLED D1; the capacitor C1 has two ends electrically connected to the gate and the source of the second TFT T2 respectively; the OLED D1 has a cathode connected to a power source negative voltage OVSS.

The voltage switching module 40 is configured to input the first power source positive voltage OVDD1 to the sources of the second TFTs T2 of the corresponding row of sub-pixels 10 when the scan signal on the scan line 20 connected thereto turning on the first P-type TFTs T1 in the corresponding row of sub-pixels, and to input the second power source positive voltage OVDD2 to the sources of the second TFTs T2 of the corresponding row of sub-pixels 10 when the scan signal on the scan line 20 connected thereto turning off the first P-type TFTs T1 in the corresponding row of sub-pixels 10.

The first power source positive voltage OVDD1 is less than the second power source positive voltage OVDD2.

Preferably, as shown in FIG. 3, each voltage switching module 40 comprises a third N-type TFT T3 and a fourth P-type TFT T4, the third N-type TFT T3 has a gate electrically connected to the corresponding scan line 20, a source connected to the second power supply positive voltage OVDD2 and a drain electrically connected to a drain of the fourth P-type TFT T4 and electrically connected to the source of the second TFT T2 of the corresponding row of the sub-pixels 10; the fourth P-type TFT T4 has a gate electrically connected to the corresponding scan line 20, and a source connected to the first power supply positive voltage OVDD1.

Preferably, as shown in FIG. 3, the second TFT T2 is a P-type TFT.

Specifically, referring to FIG. 3 and FIG. 4, the AMOLED pixel driving method of the first embodiment of the present invention is as follows:

For a positive integer n, scanning the n-th row of sub-pixels 10; first, the scan signal G(n) on the n-th scan line 20 is changed from the constant high voltage VGH to the constant low voltage VGL, and the first P-type TFTs T1 of the n-th row of sub-pixels 10 are controlled to be turned on from being turned off, and the third N-type TFTs T3 in the voltage switching module 40 connected to the n-th row of sub-pixels 10 are controlled to become turned off, and the fourth P-type TFTs T4 are turned on. The first power source positive voltage OVDD1 is written to the source of the second TFTs T2 of the n-th row of sub-pixels 10 via the turned-on fourth P-type TFT T4, that is, the voltage value V1 inputted by the voltage switching module 40 to the sources of the second TFT T2 of the n-th row of pixels 10 is the first power source positive voltage OVDD1, and a plurality of data lines 30 input data signals through the turned-on first P-type TFT T1 to the gates of the second TFTs T2 of the n-th row of sub-pixels 10.

Then, the scan signal G(n) on the n-th scan line 20 is changed from the constant low voltage VGH to the constant high voltage VGL, and the first P-type TFTs T1 of the n-th row of sub-pixels 10 are controlled to be turned off from being turned on. Although the parasitic capacitance exists between the gate and the drain of the first P-type TFT T1, the voltage of the scan signal G(n) rises, that is, the gate voltage of the first P-type TFT T1 rises, which causes the drain voltage of the first P-type TFT T1 is also increased by the effect of the parasitic capacitance. However, after the scan signal G(n) becomes the constant high voltage VGH, the third N-type TFTs T3 in the voltage switching module 40 connected to the n-th row of sub-pixels 10 are controlled to become turned on, and the fourth P-type TFTs T4 are turned off. The second power source positive voltage OVDD2 is written to the sources of the second TFTs T2 of the n-th row of sub-pixels 10 via the turned-on third N-type TFT T3, that is, the voltage value V1 inputted by the voltage switching module 40 to the sources of the second TFT T2 of the n-th row of pixels 10 is changed from the first power source positive voltage OVDD1 to the second power source positive voltage OVDD2. In other words, the voltage value V1 inputted by the voltage switching module 40 to the sources of the second TFTs T2 in the n-th row of sub-pixels 10 is also increased, so that the gate voltage and source voltage of the second TFTs T2 (i.e., the driving TFT) are also increased, which effectively reduces the change of the gate-to-source voltage difference of the second TFT T2 due to the existence of parasitic capacitance between the gate and the drain when the first P-type TFT T1 (i.e., the switching TFT) is turned off. Therefore, the driving current flowing through the OLED D1 can be kept stable, so that the OLED D1 can emit light stably, and the display consistency of the sub-pixels 10 is improved, and the display quality is improved.

Figure 4:
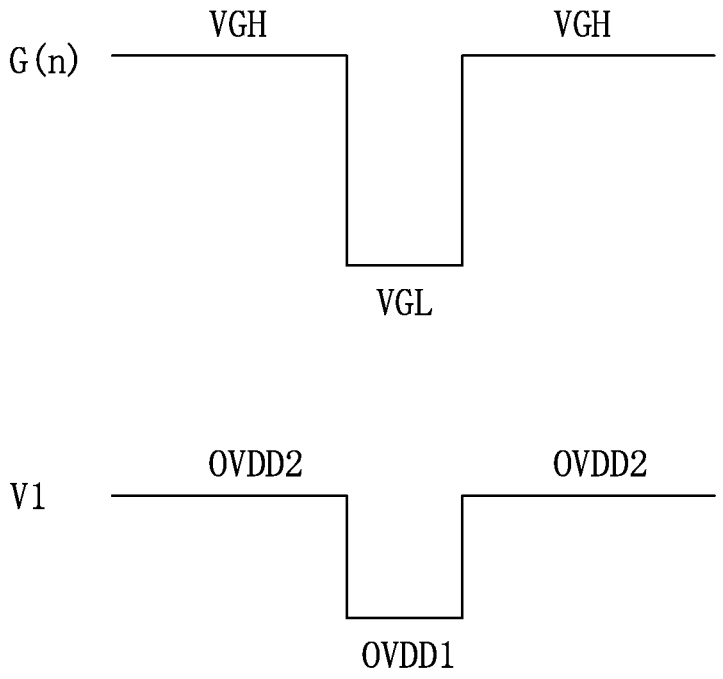
FIG. 4 is a schematic view showing the timing diagram for the AMOLED pixel driving circuit of the first embodiment of the present invention.
Figure 5:
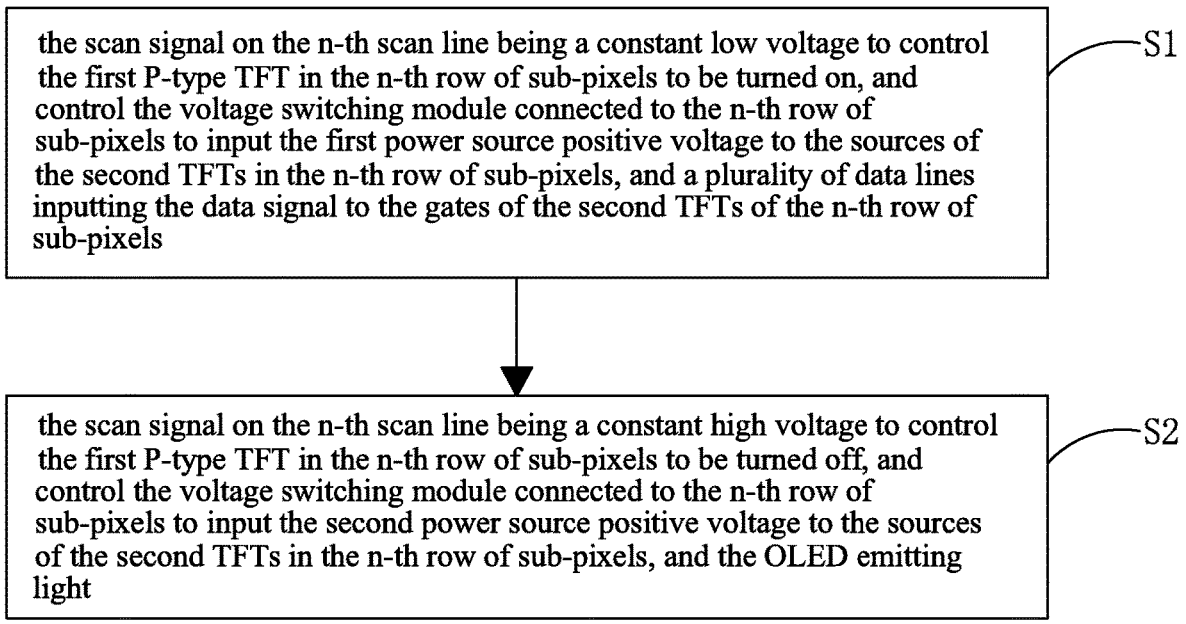
FIG. 5 is a schematic view showing the flowchart for the AMOLED pixel driving method of the first embodiment of the present invention.

Refer to FIG. 5, as well as FIG. 3 and FIG. 4. The AMOLED pixel driving method of the first embodiment of the present invention comprises the following:

Step S1: for a positive integer n, the scan signal G(n) on the n-th scan line 20 is a constant low voltage VGL, and controls the first P-type TFT T1 in the n-th row of sub-pixels 10 to be turned on, controls the voltage switching module 40 connected to the n-th row of sub-pixels 10 to input the first power source positive voltage OVDD1 to the sources of the second TFTs T2 in the n-th row of sub-pixels 10, and a plurality of data lines 30 input the data signal to the gates of the second TFTs T2 of the n-th row of sub-pixels 10.

Specifically, in step S1, the scan signal G(n) on the n-th scan line 20 is changed from the constant high voltage VGH to the constant low voltage VGL, and the first P-type TFTs T1 of the n-th row of sub-pixels 10 are controlled to be turned on from being turned off, and the third N-type TFTs T3 in the voltage switching module 40 connected to the n-th row of sub-pixels 10 are controlled to become turned off, and the fourth P-type TFTs T4 are turned on. The first power source positive voltage OVDD1 is written to the source of the second TFTs T2 of the n-th row of sub-pixels 10 via the turned-on fourth P-type TFT T4, that is, the voltage value V1 inputted by the voltage switching module 40 to the sources of the second TFT T2 of the n-th row of pixels 10 is the first power source positive voltage OVDD1, and a plurality of data lines 30 input data signals through the turned-on first P-type TFT T1 to the gates of the second TFTs T2 of the n-th row of sub-pixels 10.

Step S2: the scan signal G(n) on the n-th scan line 20 is a constant high voltage VGH, controls the first P-type TFTs T1 in the n-th row of sub-pixels 10 to be turned off, and controls the voltage switching module 40 connected to the n-th row of sub-pixels 10 to input the second power source positive voltage OVDD2 to the sources of the second TFTs T2 in the n-th row of sub-pixels 10, and the OLED D1 emits light.

Specifically, in step S2, the scan signal G(n) on the n-th scan line 20 is changed from the constant low voltage VGH to the constant high voltage VGL, and the first P-type TFTs T1 of the n-th row of sub-pixels 10 are controlled to be turned off from being turned on. Although the parasitic capacitance exists between the gate and the drain of the first P-type TFT T1, the voltage of the scan signal G(n) rises, that is, the gate voltage of the first P-type TFT T1 rises, which causes the drain voltage of the first P-type TFT T1 is also increased by the effect of the parasitic capacitance. However, after the scan signal G(n) becomes the constant high voltage VGH, the third N-type TFTs T3 in the voltage switching module 40 connected to the n-th row of sub-pixels 10 are controlled to become turned on, and the fourth P-type TFTs T4 are turned off. The second power source positive voltage OVDD2 is written to the sources of the second TFTs T2 of the n-th row of sub-pixels 10 via the turned-on third N-type TFT T3, that is, the voltage value V1 inputted by the voltage switching module 40 to the sources of the second TFT T2 of the n-th row of pixels 10 is changed from the first power source positive voltage OVDD1 to the second power source positive voltage OVDD2. In other words, the voltage value V1 inputted by the voltage switching module 40 to the sources of the second TFTs T2 in the n-th row of sub-pixels 10 is also increased, so that the gate voltage and source voltage of the second TFTs T2 (i.e., the driving TFT) are also increased, which effectively reduces the change of the gate-to-source voltage difference of the second TFT T2 due to the existence of parasitic capacitance between the gate and the drain when the first P-type TFT T1 (i.e., the switching TFT) is turned off. Therefore, the driving current flowing through the OLED D1 can be kept stable, so that the OLED D1 can emit light stably, and the display consistency of the sub-pixels 10 is improved, and the display quality is improved.

Figure 6:
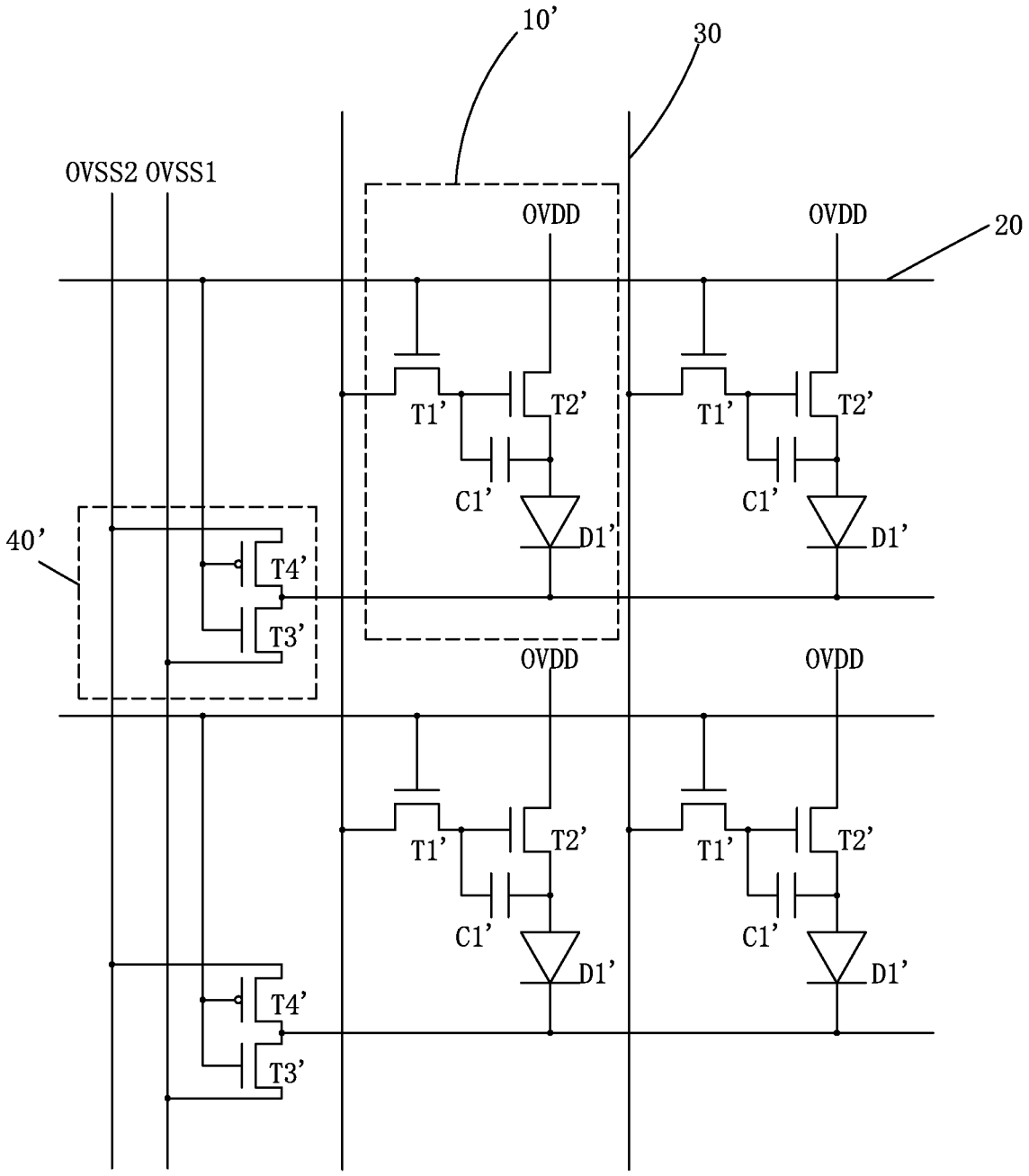
FIG. 6 is a schematic view showing the AMOLED pixel driving circuit of the second embodiment of the present invention.

Refer to FIG. 6. The AMOLED pixel driving circuit of the second embodiment of the present invention comprises: a plurality of sub-pixels 10' arranged in an array, a plurality of scan lines 20, a plurality of data lines 30, and a plurality of voltage switching modules 40'.

Each column of sub-pixels 10' is connected to a data line 30; each row of sub-pixels 10' is correspondingly connected with a scan line 20; each voltage switching module 40' is correspondingly connected with a row of sub-pixels 10' and the scan line 20 connected by the row of sub-pixels 10, and connected to a first power source negative voltage OVSS1 and a second power source negative voltage OVSS2.

Each of the sub-pixels 10' comprises a first N-type TFT T1', a second TFT T2', a capacitor C1, and an OLED D1'; the first N-type TFT T1' has a gate electrically connected to the corresponding scan line 20, a source electrically connected to the corresponding data line 30, and a drain electrically connected to a gate of the second TFT T2'; the second TFT T2 has a drain electrically connected to a power source positive voltage OVDD, and a source electrically connected to an anode of the OLED D1; the capacitor C1 has two ends electrically connected to the gate and the source of the second TFT T2 respectively; the OLED D1 has a cathode connected to the corresponding voltage switching module 40'.

The voltage switching module 40' is configured to input the first power source negative voltage OVSS1 to the cathodes of the OLEDs D1' of the corresponding row of sub-pixels 10' when the scan signal on the scan line 20 connected thereto turning on the first N-type TFTs T1' in the corresponding row of sub-pixels, and to input the second power source negative voltage OVSS2 to the cathodes of the OLEDs D1' of the corresponding row of sub-pixels 10' when the scan signal on the scan line 20 connected thereto turning off the first N-type TFTs T1' in the corresponding row of sub-pixels 10'.

The first power source negative voltage OVSS1 is larger than the second power source positive voltage OVSS2.

Preferably, as shown in FIG. 6, each voltage switching module 40' comprises a third N-type TFT T3' and a fourth P-type TFT T4', the third N-type TFT T3' has a gate electrically connected to the corresponding scan line 20, a source connected to the first power supply negative voltage OVSS1 and a drain electrically connected to a drain of the fourth P-type TFT T4' and electrically connected to the cathode of the OLED D1' of the corresponding row of the sub-pixels 10'; the fourth P-type TFT T4' has a gate electrically connected to the corresponding scan line 20, and a source connected to the second power supply negative voltage OVSS2.

Preferably, as shown in FIG. 6, the second TFT T2' is an N-type TFT.

Specifically, referring to FIG. 6 and FIG. 7, the AMOLED pixel driving method of the second embodiment of the present invention is as follows:

For a positive integer n, scanning the n-th row of sub-pixels 10'; first, the scan signal G(n) on the n-th scan line 20 is changed from the constant low voltage VGL to the constant high voltage VGH, and the first N-type TFTs T1' of the n-th row of sub-pixels 10' are controlled to be turned on from being turned off, and the third N-type TFTs T3' in the voltage switching module 40' connected to the n-th row of sub-pixels 10' are controlled to become turned on, and the fourth P-type TFTs T4' are turned off. The first power source negative voltage OVSS1 is written to the cathodes of the OLEDs D1 of the n-th row of sub-pixels 10' via the turned-on fourth P-type TFT T4, that is, the voltage value V2 inputted by the voltage switching module 40 to the cathodes of the OLEDs D1' of the n-th row of pixels 10 is the first power source negative voltage OVSS1, and a plurality of data lines 30 input data signals through the turned-on first N-type TFT T1' to the gates of the second TFTs T2' of the n-th row of sub-pixels 10'.

Then, the scan signal G(n) on the n-th scan line 20 is changed from the constant high voltage VGL to the constant low voltage VGH, and the first N-type TFTs T1' of the n-th row of sub-pixels 10' are controlled to be turned on from being turned off. Although the parasitic capacitance exists between the gate and the drain of the first N-type TFT T1', the voltage of the scan signal G(n) drops, that is, the gate voltage of the first N-type TFT T1' drops, which causes the drain voltage of the first N-type TFT T1' is also decreased by the effect of the parasitic capacitance. However, after the scan signal G(n) becomes the constant low voltage VGL, the third N-type TFTs T3' in the voltage switching module 40' connected to the n-th row of sub-pixels 10' are controlled to become turned off, and the fourth P-type TFTs T4' are turned on. The second power source negative voltage OVSS2 is written to the cathodes of the OLEDs D1' of the n-th row of sub-pixels 10' via the turned-on fourth P-type TFT T4', that is, the voltage value V2 inputted by the voltage switching module 40' to the cathodes of the OLEDs D1' of the n-th row of pixels 10 is changed from the first power source negative voltage OVSS1 to the second power source negative voltage OVSS2. In other words, the voltage value V2 inputted by the voltage switching module 40' to the cathodes of the OLEDs D1' in the n-th row of sub-pixels 10 is also decreased, so that the gate voltage and source voltage of the second TFTs T2' (i.e., the driving TFT) are also decreased, which effectively reduces the change of the gate-to-source voltage difference of the second TFT T2' due to the existence of parasitic capacitance between the gate and the drain when the first N-type TFT T1' (i.e., the switching TFT) is turned off. Therefore, the driving current flowing through the OLED D1' can be kept stable, so that the OLED D1' can emit light stably, and the display consistency of the sub-pixels 10' is improved, and the display quality is improved.

Figure 7:
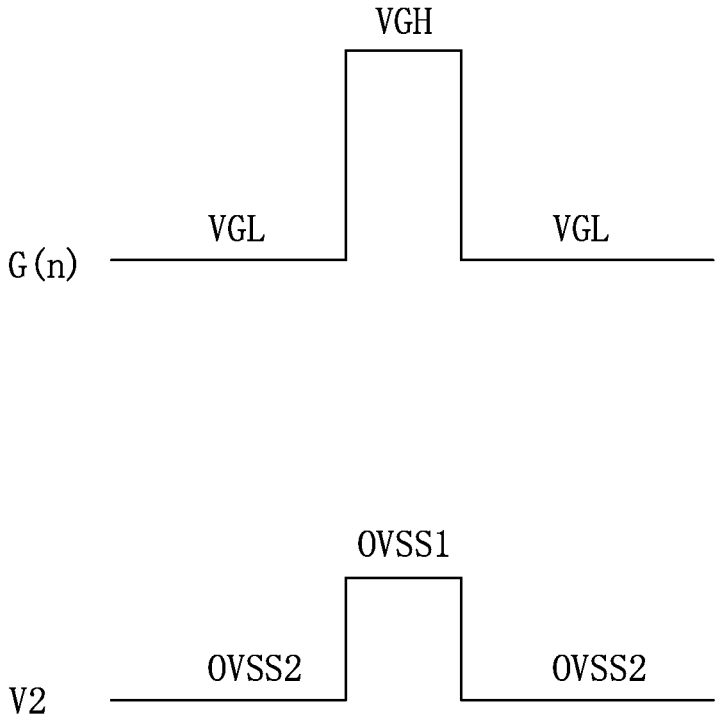
FIG. 7 is a schematic view showing the timing diagram for the AMOLED pixel driving circuit of the second embodiment of the present invention.
Figure 8:
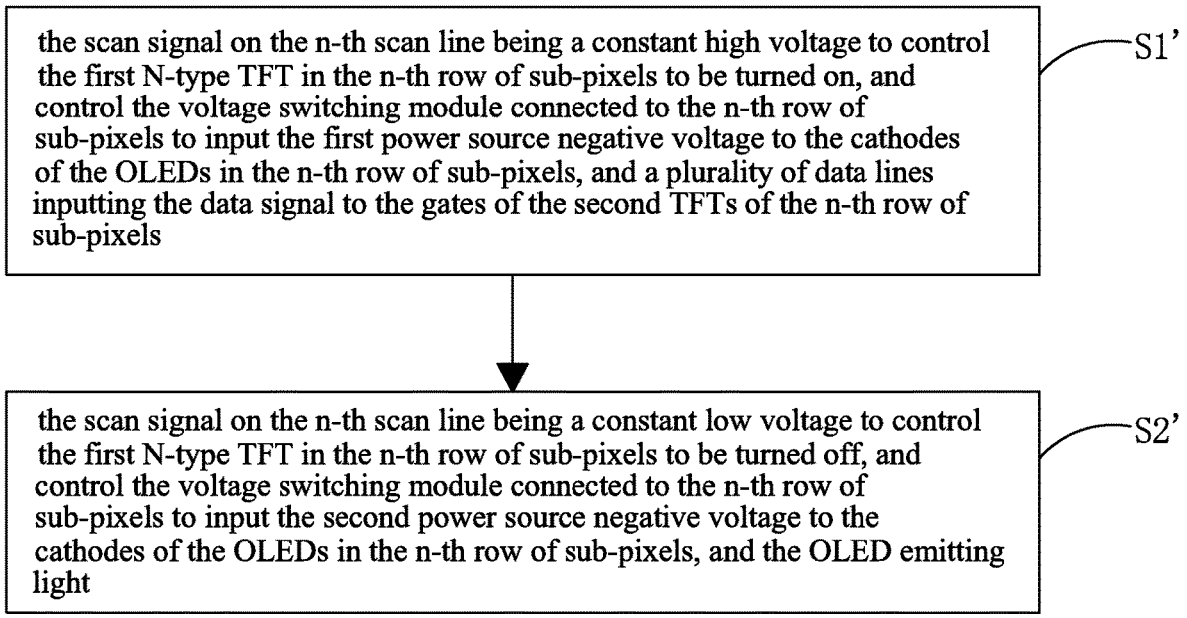
FIG. 8 is a schematic view showing the flowchart for the AMOLED pixel driving method of the second embodiment of the present invention.

Refer to FIG. 8, as well as FIG. 6 and FIG. 7. The AMOLED pixel driving method of the second embodiment of the present invention, applicable to the second embodiment of the AMOLED pixel driving circuit of the present invention, comprises the following:

Step S1': for a positive integer n, the scan signal G(n) on the n-th scan line 20 is a constant high voltage VGH, and controls the first N-type TFT T1' in the n-th row of sub-pixels 10' to be turned on, controls the voltage switching module 40' connected to the n-th row of sub-pixels 10' to input the first power source negative voltage OVSS1 to the cathodes of the OLEDs in the n-th row of sub-pixels 10', and a plurality of data lines 30 input the data signal to the gates of the second TFTs T2' of the n-th row of sub-pixels 10'.

Specifically, in step S1', the scan signal G(n) on the n-th scan line 20 is changed from the constant low voltage VGL to the constant high voltage VGH, and the first N-type TFTs T1' of the n-th row of sub-pixels 10' are controlled to be turned on from being turned off, and the third N-type TFTs T3' in the voltage switching module 40' connected to the n-th row of sub-pixels 10' are controlled to become turned on, and the fourth P-type TFTs T4' are turned off. The first power source negative voltage OVSS1 is written to the cathodes of the OLEDs D1 of the n-th row of sub-pixels 10' via the turned-on fourth P-type TFT T4, that is, the voltage value V2 inputted by the voltage switching module 40 to the cathodes of the OLEDs D1' of the n-th row of pixels 10 is the first power source negative voltage OVSS1, and a plurality of data lines 30 input data signals through the turned-on first N-type TFT T1' to the gates of the second TFTs T2' of the n-th row of sub-pixels 10'.

Step S2': the scan signal G(n) on the n-th scan line 20 is a constant low voltage VGL, controls the first N-type TFTs T1' in the n-th row of sub-pixels 10' to be turned off, and controls the voltage switching module 40' connected to the n-th row of sub-pixels 10' to input the second power source negative voltage OVSS2 to the cathodes of the OLEDs D1' in the n-th row of sub-pixels 10', and the OLED D1' emits light.

Specifically, in step S2, the scan signal G(n) on the n-th scan line 20 is changed from the constant high voltage VGL to the constant low voltage VGH, and the first N-type TFTs T1' of the n-th row of sub-pixels 10' are controlled to be turned on from being turned off. Although the parasitic capacitance exists between the gate and the drain of the first N-type TFT T1', the voltage of the scan signal G(n) drops, that is, the gate voltage of the first N-type TFT T1' drops, which causes the drain voltage of the first N-type TFT T1' is also decreased by the effect of the parasitic capacitance. However, after the scan signal G(n) becomes the constant low voltage VGL, the third N-type TFTs T3' in the voltage switching module 40' connected to the n-th row of sub-pixels 10' are controlled to become turned off, and the fourth P-type TFTs T4' are turned on. The second power source negative voltage OVSS2 is written to the cathodes of the OLEDs D1' of the n-th row of sub-pixels 10' via the turned-on fourth P-type TFT T4', that is, the voltage value V2 inputted by the voltage switching module 40' to the cathodes of the OLEDs D1' of the n-th row of pixels 10 is changed from the first power source negative voltage OVSS1 to the second power source negative voltage OVSS2. In other words, the voltage value V2 inputted by the voltage switching module 40' to the cathodes of the OLEDs D1' in the n-th row of sub-pixels 10 is also decreased, so that the gate voltage and source voltage of the second TFTs T2' (i.e., the driving TFT) are also decreased, which effectively reduces the change of the gate-to-source voltage difference of the second TFT T2' due to the existence of parasitic capacitance between the gate and the drain when the first N-type TFT T1' (i.e., the switching TFT) is turned off. Therefore, the driving current flowing through the OLED D1' can be kept stable, so that the OLED D1' can emit light stably, and the display consistency of the sub-pixels 10' is improved, and the display quality is improved.

In summary, the present invention provides an AMOLED pixel driving circuit, which is disposed with a voltage switching module corresponding to each row of sub-pixels, and the voltage switching module is connected to a corresponding row of sub-pixels and scan line corresponding to the row of sub-pixels. The scan signal on the scan line controls the corresponding voltage switching module to provide different power supply voltages to the row of sub-pixels when the switching TFTs in the corresponding row of sub-pixels are turned on and off, thereby compensating for the voltage difference change caused by the parasitic capacitance between the drain and the gate of the switching TFT when the switching TFT changes from on to off, ensuring a stable current flowing through the OLED, and improving the display consistency of the sub-pixels to ensure display quality. The present invention provides an AMOLED pixel driving method capable of improving the brightness change of the OLED caused by the parasitic capacitance between the gate and the drain of the switching TFT when the scan signal turns off the switching TFT to improve display quality.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. An active matrix organic light-emitting diode (AMOLED) pixel driving circuit, comprising: a plurality of sub-pixels arranged in an array, a plurality of scan lines, a plurality of data lines, and a plurality of voltage switching modules;

each column of sub-pixels being connected to a data line; each row of sub-pixels being correspondingly connected with a scan line; each voltage switching module being correspondingly connected with a row of sub-pixels and the scan line connected by the row of sub-pixel elements, and connected to a first power source positive voltage and a second power source positive voltage;

each of the sub-pixels comprising a first P-type thin film transistor (TFT), a second TFT, a capacitor, and an OLED; the first P-type TFT having a gate electrically connected to the corresponding scan line, a source electrically connected to the corresponding data line, and a drain electrically connected to a gate of the second TFT; the second TFT having a source electrically connected to the corresponding voltage switching module, and a drain electrically connected to an anode of the OLED; the capacitor having two ends electrically connected to the gate and the source of the second TFT respectively; the OLED having a cathode connected to a power source negative voltage;

the voltage switching module being configured to input the first power source positive voltage to the sources of the second TFTs of the corresponding row of sub-pixels when the scan signal on the scan line connected thereto turns on the first P-type TFTs in the corresponding row of sub-pixels, and to input the second power source positive voltage to the sources of the second TFTs of the corresponding row of sub-pixels when the scan signal on the scan line connected thereto turns off the first P-type TFTs in the corresponding row of sub-pixels;

wherein the first power source positive voltage that is input to the sources of the second TFTs when the scan signal turns on the first P-type TFTs is of a level lower than a level of the second power source positive voltage that is input to the sources of the second TFTs when the scan signal turns off the first P-type TFTs, and wherein the scan signal of the scan line is switchable between a first scan-signal level in a turn-on interval of the first P-type TFTs and a second scan-signal level in a turn-off interval of the first P-type TFTs, and the voltage switching module is switchable between the first power source positive voltage in a first time interval that corresponds to the turn-on interval of the scan signal and the second power source positive voltage in a second time interval that corresponds to the turn-off interval of the scan signal, wherein switching between the first scan-signal level and the second scan-signal level of the scan signal of the scan line chronically corresponds to switching between the first power source positive voltage and the second power source positive voltage of the voltage switching module.

2. An active matrix organic light-emitting diode (AMOLED) pixel driving method, applicable to an AMOLED pixel driving circuit as claimed in claim 1, comprising: a plurality of sub-pixels arranged in an array, a plurality of scan lines, a plurality of data lines, and a plurality of voltage switching modules;

Step S1: for a positive integer n, the scan signal on the n-th scan line being a constant low voltage to control the first P-type TFT in the n-th row of sub-pixels to be turned on, and control the voltage switching module connected to the n-th row of sub-pixels to input the first power source positive voltage to the sources of the second TFTs in the n-th row of sub-pixels, and a plurality of data lines inputting the data signal to the gates of the second TFTs of the n-th row of sub-pixels;

Step S2: the scan signal on the n-th scan line being a constant high voltage to control the first P-type TFT in the n-th row of sub-pixels to be turned off, and control the voltage switching module connected to the n-th row of sub-pixels to input the second power source positive voltage to the sources of the second TFTs in the n-th row of sub-pixels, and the OLED emitting light.

3. The AMOLED pixel driving circuit as claimed in claim 1, wherein each voltage switching module comprises a third N-type TFT and a fourth P-type TFT, the third N-type TFT has a gate electrically connected to the corresponding scan line, a source connected to the second power supply positive voltage and a drain electrically connected to a drain of the fourth P-type TFT and electrically connected to the source of the second TFT of the corresponding row of the sub-pixels; the fourth P-type TFT has a gate electrically connected to the corresponding scan line, and a source connected to the first power supply positive voltage.

4. The AMOLED pixel driving circuit as claimed in claim 3, wherein the second TFT is a P-type TFT.

5. An active matrix organic light-emitting diode (AMOLED) pixel driving circuit, comprising: a plurality of sub-pixels arranged in an array, a plurality of scan lines, a plurality of data lines, and a plurality of voltage switching modules;

each column of sub-pixels being connected to a data line; each row of sub-pixels being correspondingly connected with a scan line; each voltage switching module being correspondingly connected with a row of sub-pixels and the scan line connected by the row of sub-pixel elements, and connected to a first power source positive voltage and a second power source positive voltage;

each of the sub-pixels comprising a first N-type TFT, a second TFT, a capacitor, and an OLED; the first N-type TFT having a gate electrically connected to the corresponding scan line, a source electrically connected to the corresponding data line, and a drain electrically connected to a gate of the second TFT; the second TFT having a drain electrically connected to to power source positive voltage, and a source electrically connected to an anode of the OLED; the capacitor having two ends electrically connected to the gate and the source of the second TFT respectively; the OLED having a cathode connected to the corresponding voltage switching module;

the voltage switching module being configured to input the first power source negative voltage to the cathodes of the OLEDs of the corresponding row of sub-pixels when the scan signal on the scan line connected thereto turns on the first N-type TFTs in the corresponding row of sub-pixels, and to input the second power source negative voltage to the cathodes of the OLEDs of the corresponding row of sub-pixels when the scan signal on the scan line connected thereto turns off the first N-type TFTs in the corresponding row of sub-pixels;

wherein the first power source negative voltage that is input to the cathodes the OLEDs when the scan signal turns on the first N-type TFTs is of a level higher than a level of the second power source negative voltage that is input to the cathodes the OLEDs when the scan signal turns off the first N-type TFTs, and wherein the scan signal of the scan line is switchable between a first scan-signal level in a turn-on interval of the first N-type TFTs and a second scan-signal level in a turn-off interval of the first N-type TFTs, and the voltage switching module is switchable between the first power source negative voltage in a first time interval that corresponds to the turn-on interval of the scan signal and the second power source negative voltage in a second time interval that corresponds to the turn-off interval of the scan signal, wherein switching between the first scan-signal level and the second scan-signal level of the scan signal of the scan line chronically corresponds to switching between the first power source negative voltage and the second power source negative voltage of the voltage switching module.

6. The AMOLED pixel driving circuit as claimed in claim 5, wherein each voltage switching module comprises a third N-type TFT and a fourth P-type TFT, the third N-type TFT has a gate electrically connected to the corresponding scan line, a source connected to the first power supply negative voltage and a drain electrically connected to a drain of the fourth P-type TFT and electrically connected to the cathode of the OLED of the corresponding row of the sub-pixels; the fourth P-type TFT has a gate electrically connected to the corresponding scan line, and a source connected to the second power supply negative voltage.

7. The AMOLED pixel driving circuit as claimed in claim 6, wherein the second TFT is an N-type TFT.

* * * * *